US011198960B2

(12) United States Patent
Taniguchi et al.

(10) Patent No.: US 11,198,960 B2
(45) Date of Patent: Dec. 14, 2021

(54) WARP KNITTED FABRIC AND MANUFACTURING METHOD THEREOF

(71) Applicant: SEIREN CO., LTD., Fukui (JP)

(72) Inventors: Yuichi Taniguchi, Fukui (JP); Isao Honda, Fukui (JP)

(73) Assignee: SEIREN CO., LTD., Fukui (JP)

( * ) Notice: Subject to any disclaimer, the term of this patent is extended or adjusted under 35 U.S.C. 154(b) by 141 days.

(21) Appl. No.: 16/498,153

(22) PCT Filed: Mar. 19, 2018

(86) PCT No.: PCT/JP2018/010760
§ 371 (c)(1),
(2) Date: Sep. 26, 2019

(87) PCT Pub. No.: WO2018/180684
PCT Pub. Date: Oct. 4, 2018

(65) Prior Publication Data

US 2020/0190713 A1 Jun. 18, 2020

(30) Foreign Application Priority Data

Mar. 30, 2017 (JP) ..... JP2017-067408

(51) Int. Cl.
*D04B 21/06* (2006.01)

(52) U.S. Cl.
CPC ..... *D04B 21/06* (2013.01); *D10B 2331/04* (2013.01)

(58) Field of Classification Search
None
See application file for complete search history.

(56) References Cited

U.S. PATENT DOCUMENTS 3,952,555 A * 4/1976 Lesley ..... D04B 21/16 66/195
4,748,078 A * 5/1988 Doi ..... D04B 21/12 442/312

(Continued)

FOREIGN PATENT DOCUMENTS

JP 48-21183 Y1 6/1973
JP 54-37546 B2 11/1979

(Continued)

OTHER PUBLICATIONS

International Search Report dated Jun. 26, 2018, issued in counterpart International Application No. PCT/JP2018/010760, with English Translation. (4 pages).

*Primary Examiner* — Khoa D Huynh
*Assistant Examiner* — Grace Huang
(74) *Attorney, Agent, or Firm* — Westerman, Hattori, Daniels & Adrian, LLP

(57) ABSTRACT

A warp knitted fabric formed of yarns fed from at least three guide bars including front, middle, and back guide bars, in which a back yarn fed from the back guide bar forms a cord knit texture, a front yarn fed from the front guide bar and a middle yarn fed from the middle guide bar are arranged alternately in a weft direction, each of the front yarn and the middle yarn forms a stitch formation texture (a denbigh knit texture or a cord knit texture) and an insertion texture alternately in a warp direction, and the insertion texture formed by the front yarn and the insertion texture formed by the middle yarn are arranged alternately at least in the warp direction so that the front yarn and the middle yarn are exposed alternately at least in the warp direction on sinker loops of the back yarn.

12 Claims, 15 Drawing Sheets

(56) References Cited

U.S. PATENT DOCUMENTS

| | | | | | |
|---|---|---|---|---|---|
| 4,881,383 | A * | 11/1989 | Spillane | D04B 21/02 | 66/194 |
| 5,029,457 | A * | 7/1991 | Gajjar | D04B 21/06 | 66/195 |
| 5,596,888 | A * | 1/1997 | McLarty, III | D04B 21/18 | 66/192 |
| 5,791,164 | A * | 8/1998 | Carroll | D04B 21/04 | 66/194 |
| 6,845,639 | B1 * | 1/2005 | Hajek | A44B 18/0034 | 66/195 |
| 7,465,683 | B2 * | 12/2008 | McMurray | D04B 21/18 | 442/314 |
| 9,382,649 | B2 * | 7/2016 | Yuikawa | D04B 23/16 | |
| 2009/0111348 | A1 * | 4/2009 | Shoyama | D03D 11/00 | 442/414 |
| 2013/0298612 | A1 | 11/2013 | Yuikawa et al. | | |
| 2019/0233990 | A1 * | 8/2019 | Yoshida | D04B 21/18 | |

FOREIGN PATENT DOCUMENTS

| | | | | |
|---|---|---|---|---|
| JP | 8-269851 | A | | 10/1996 |
| JP | 2003-41467 | A | | 2/2003 |
| JP | 2008-69486 | A | | 3/2008 |
| JP | 2008069486 | A | * | 3/2008 |
| JP | 2011-62377 | A | | 3/2011 |
| JP | 2012-140724 | A | | 7/2012 |

* cited by examiner

Fig.5 Examples 1 and 6
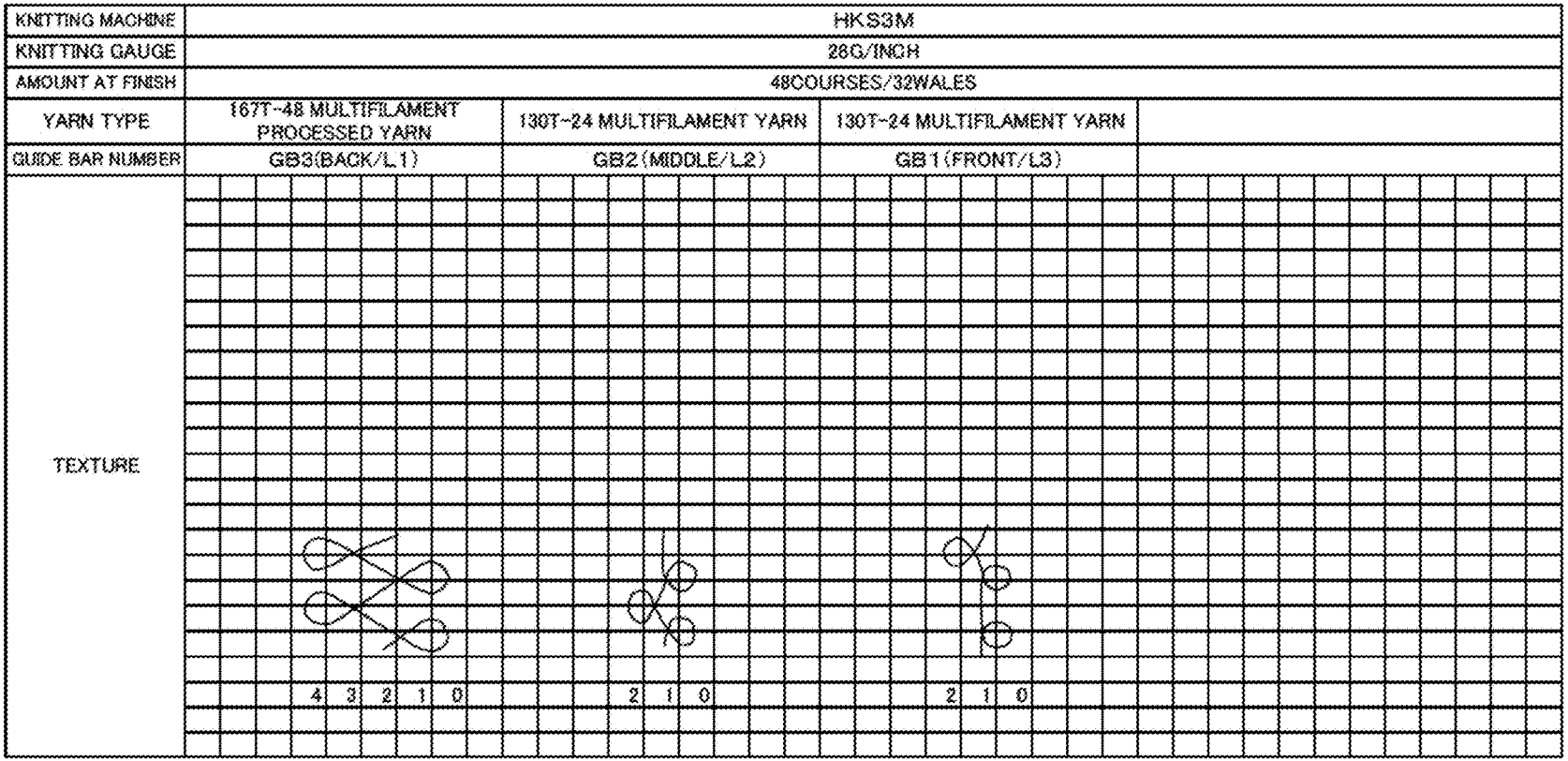

Fig.8 Example 2
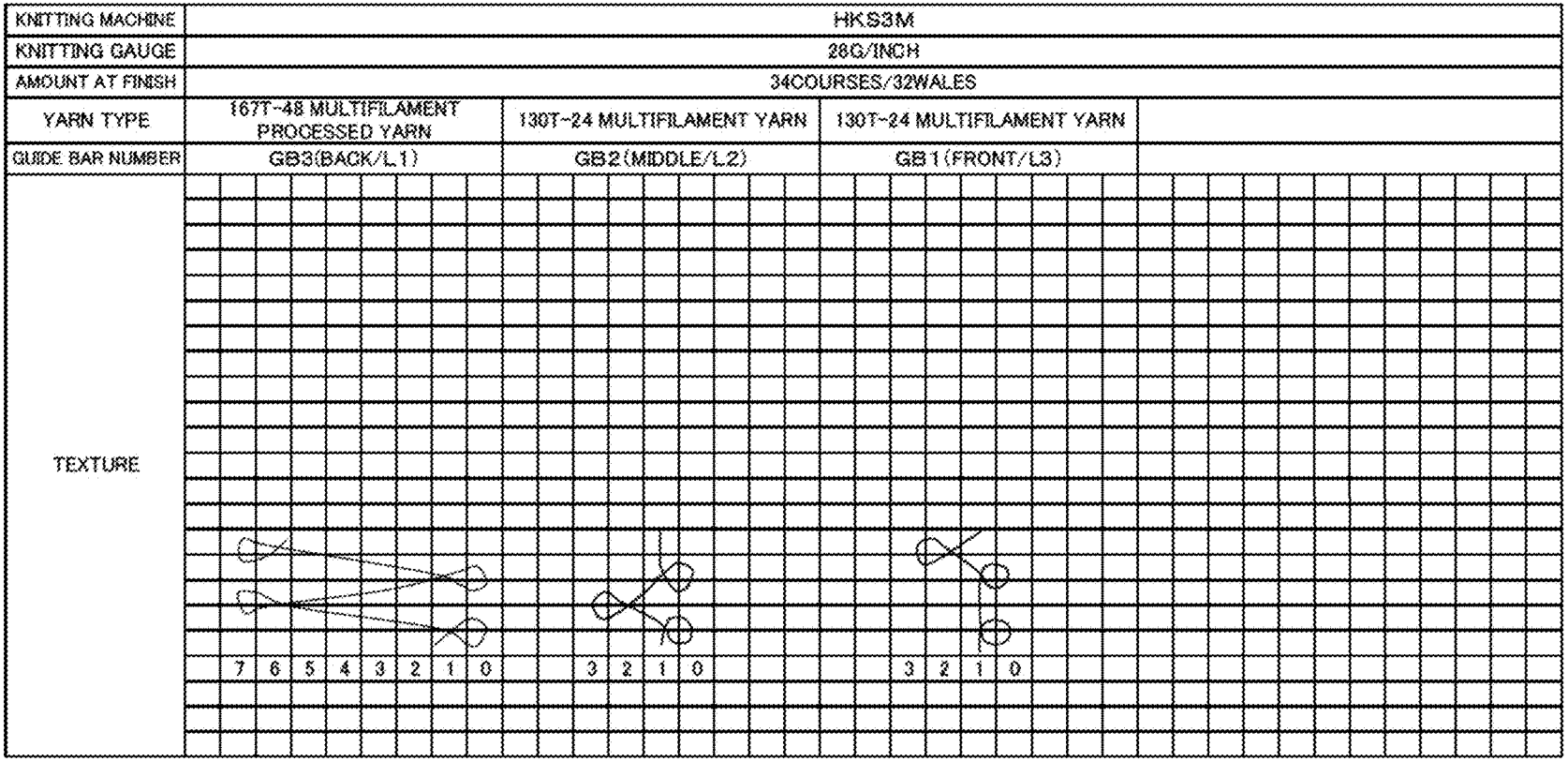

Fig.7 Example 3
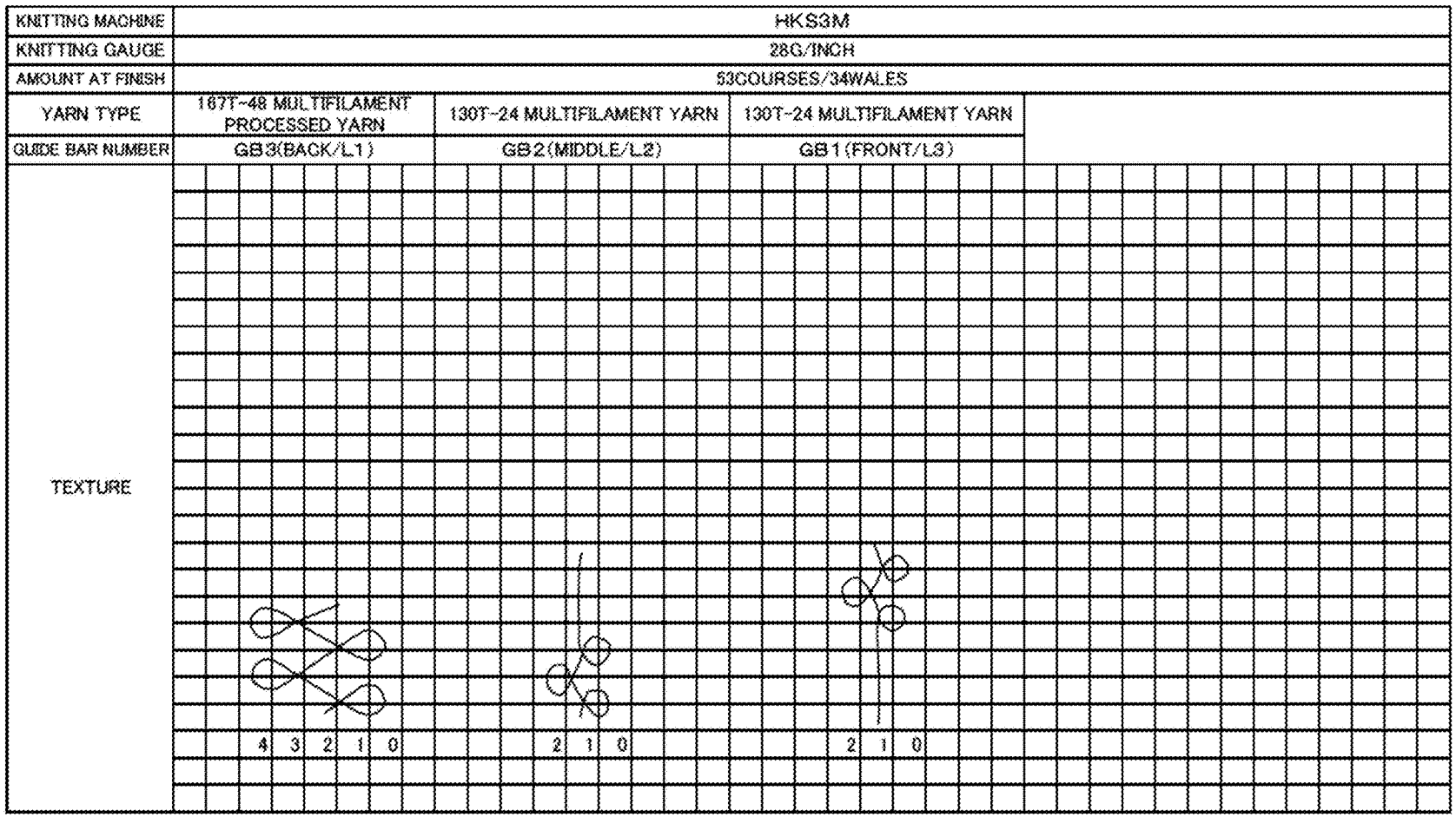

Fig.8 Example 4
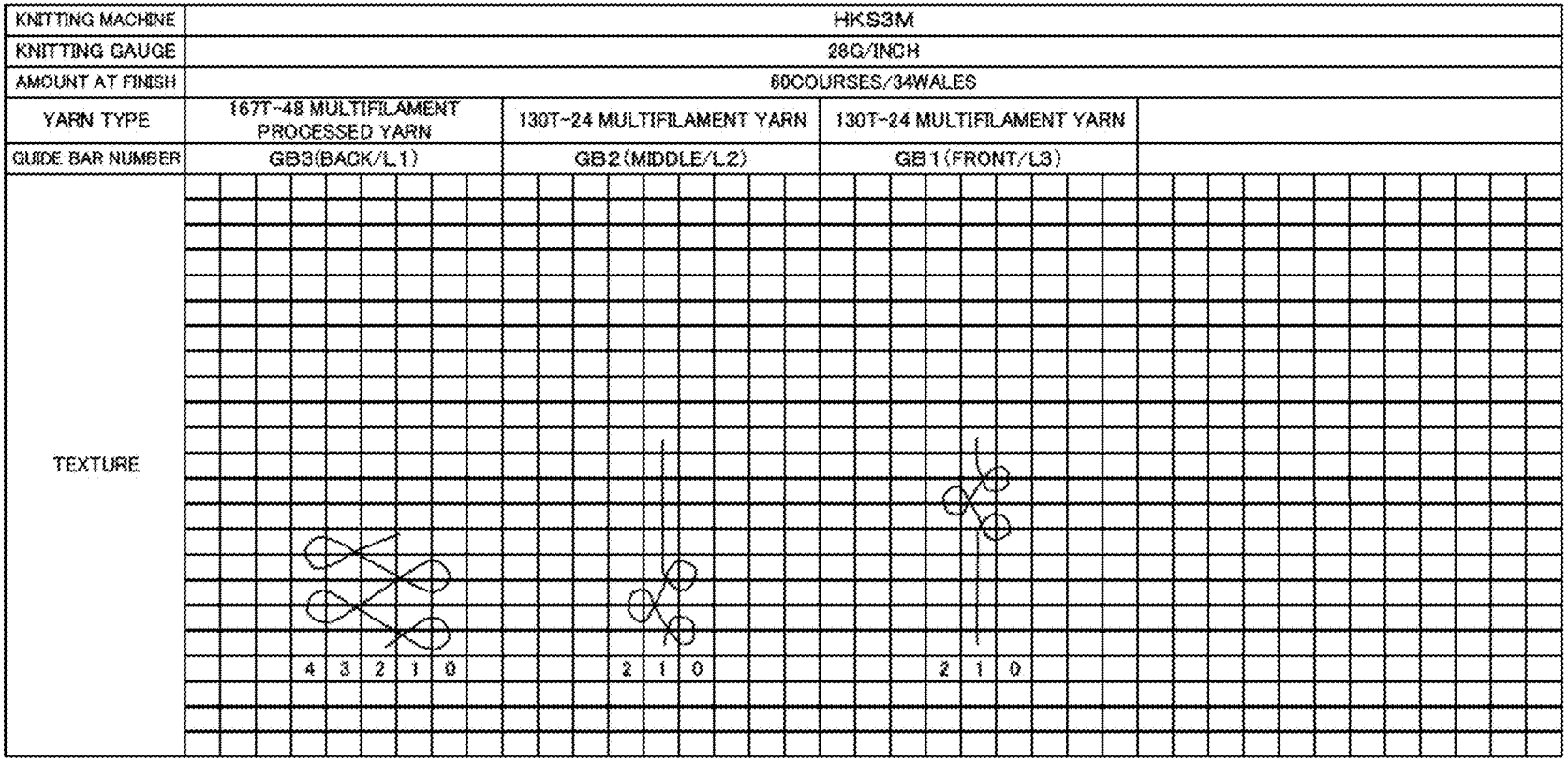

Fig.9 Example 5
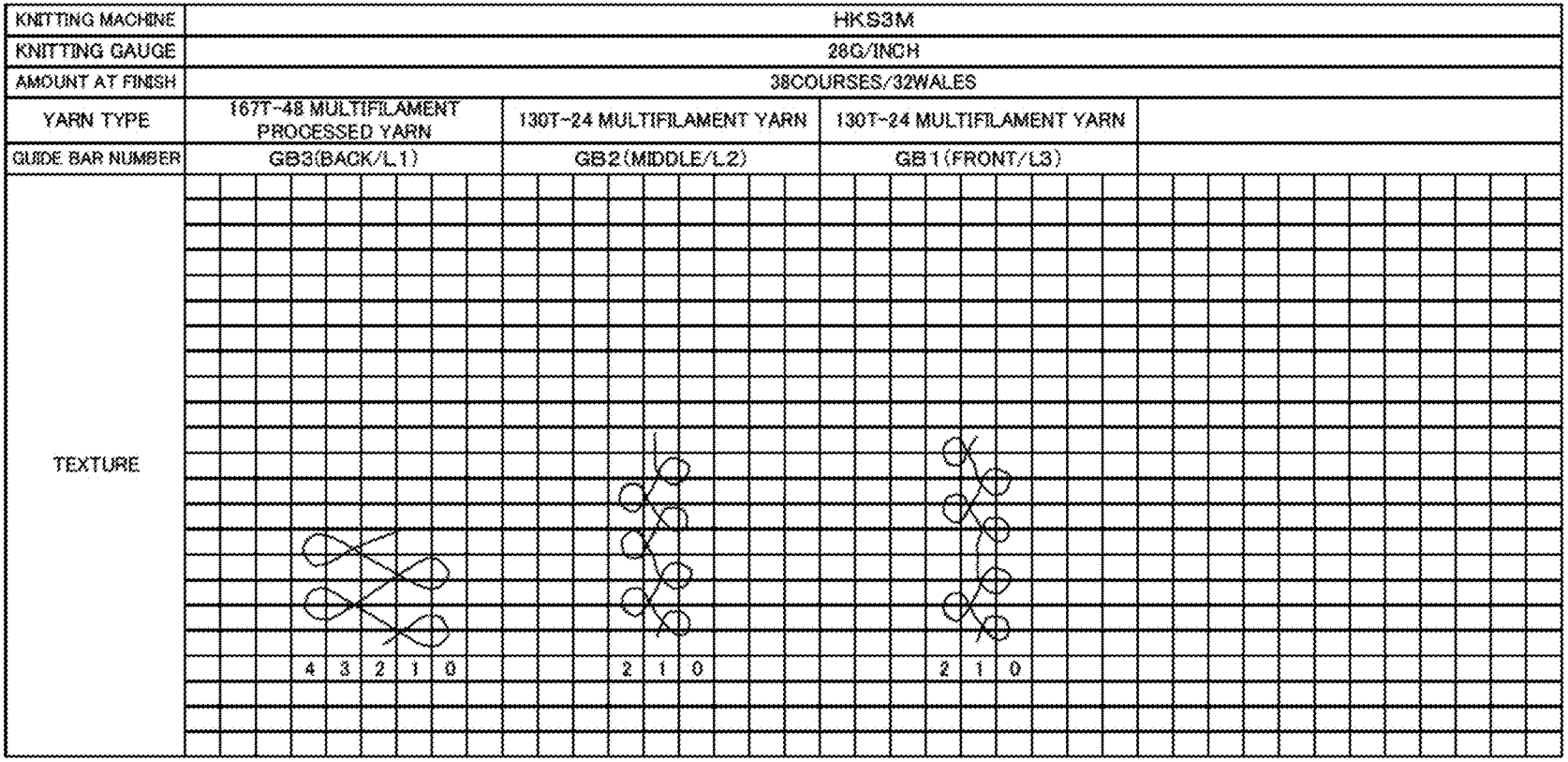

Fig.10 Example 7
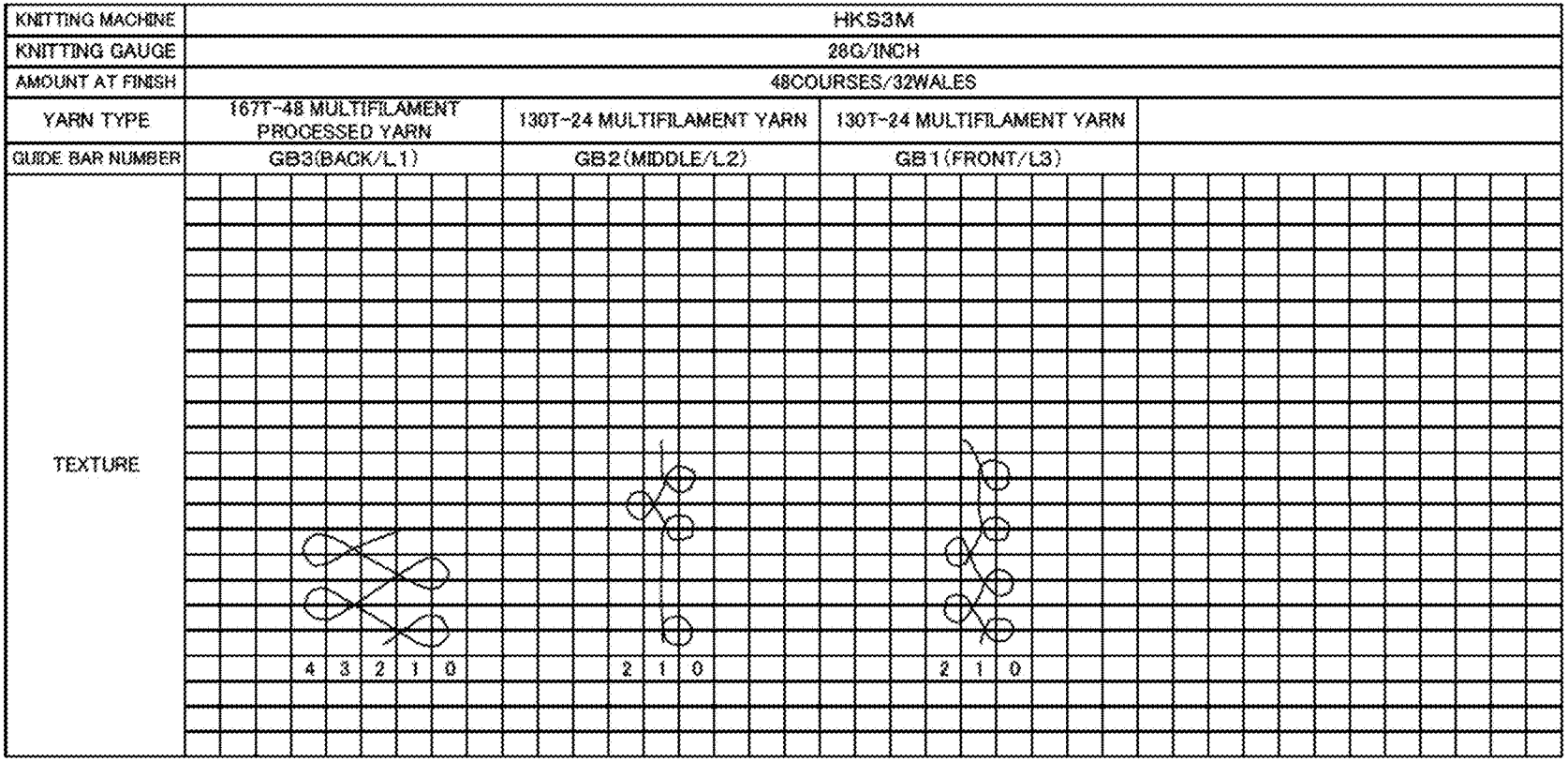

Fig.11 Example 8
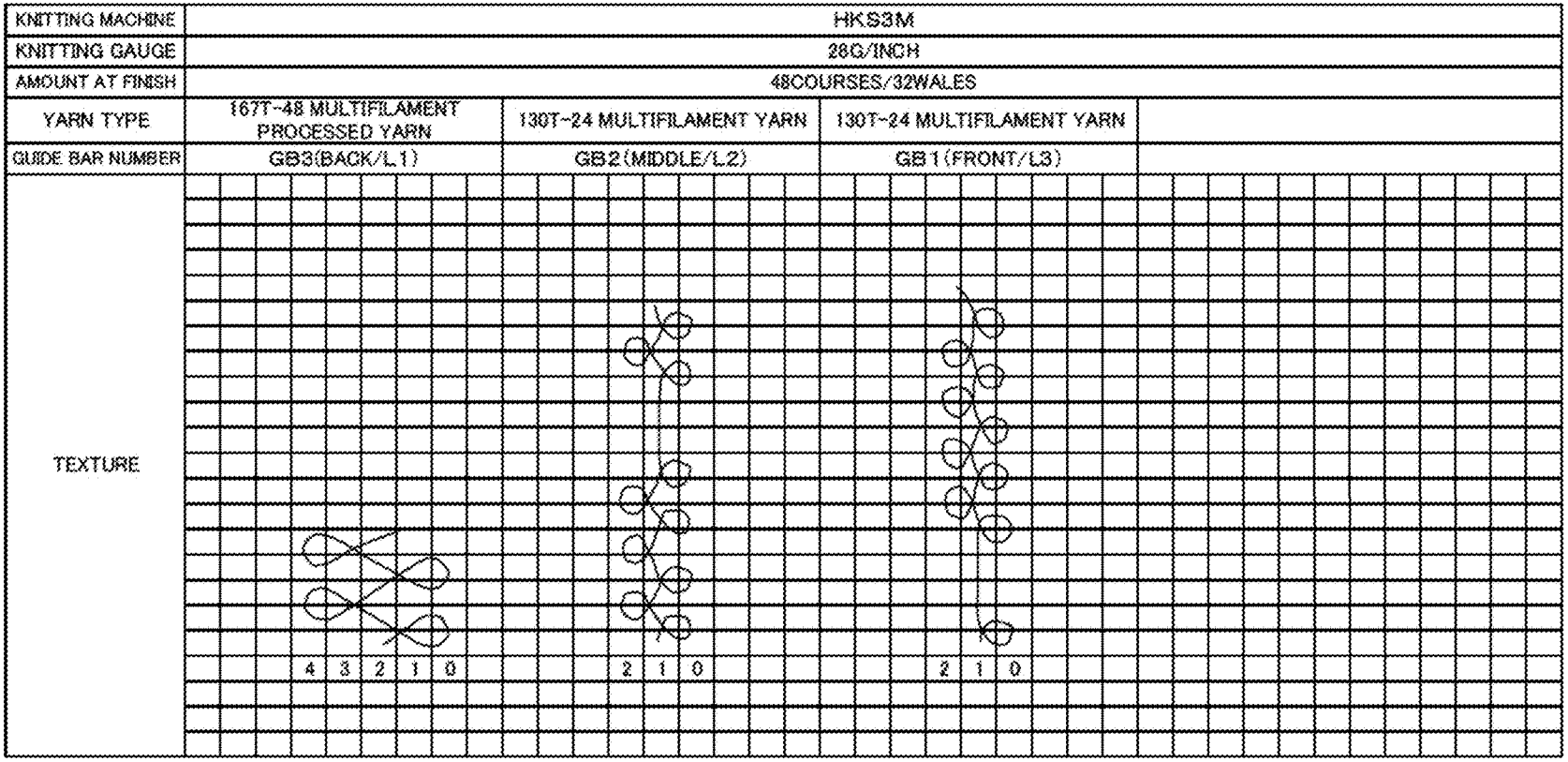

Fig.12 Comparative Example 1
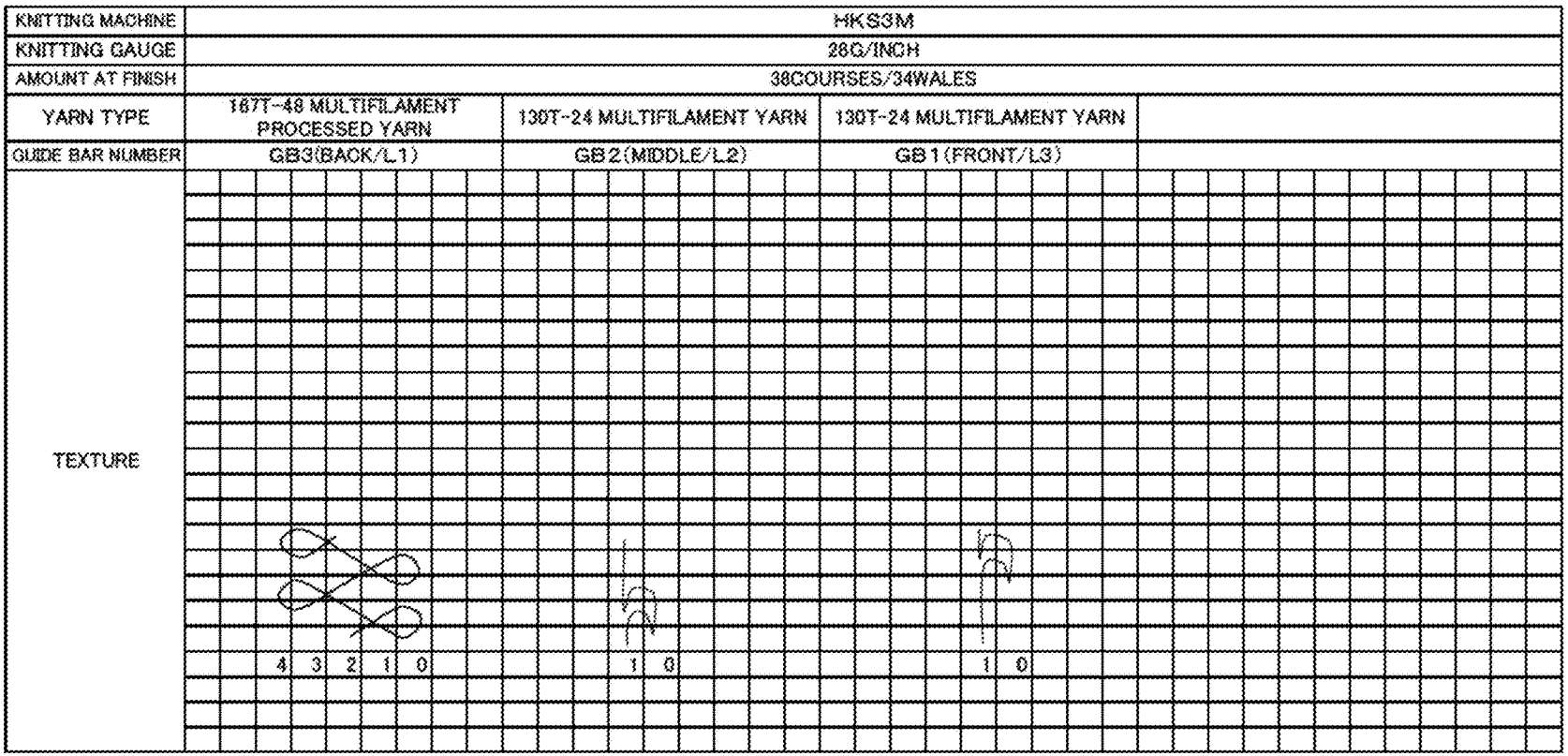

Fig.13 Comparative Example 2
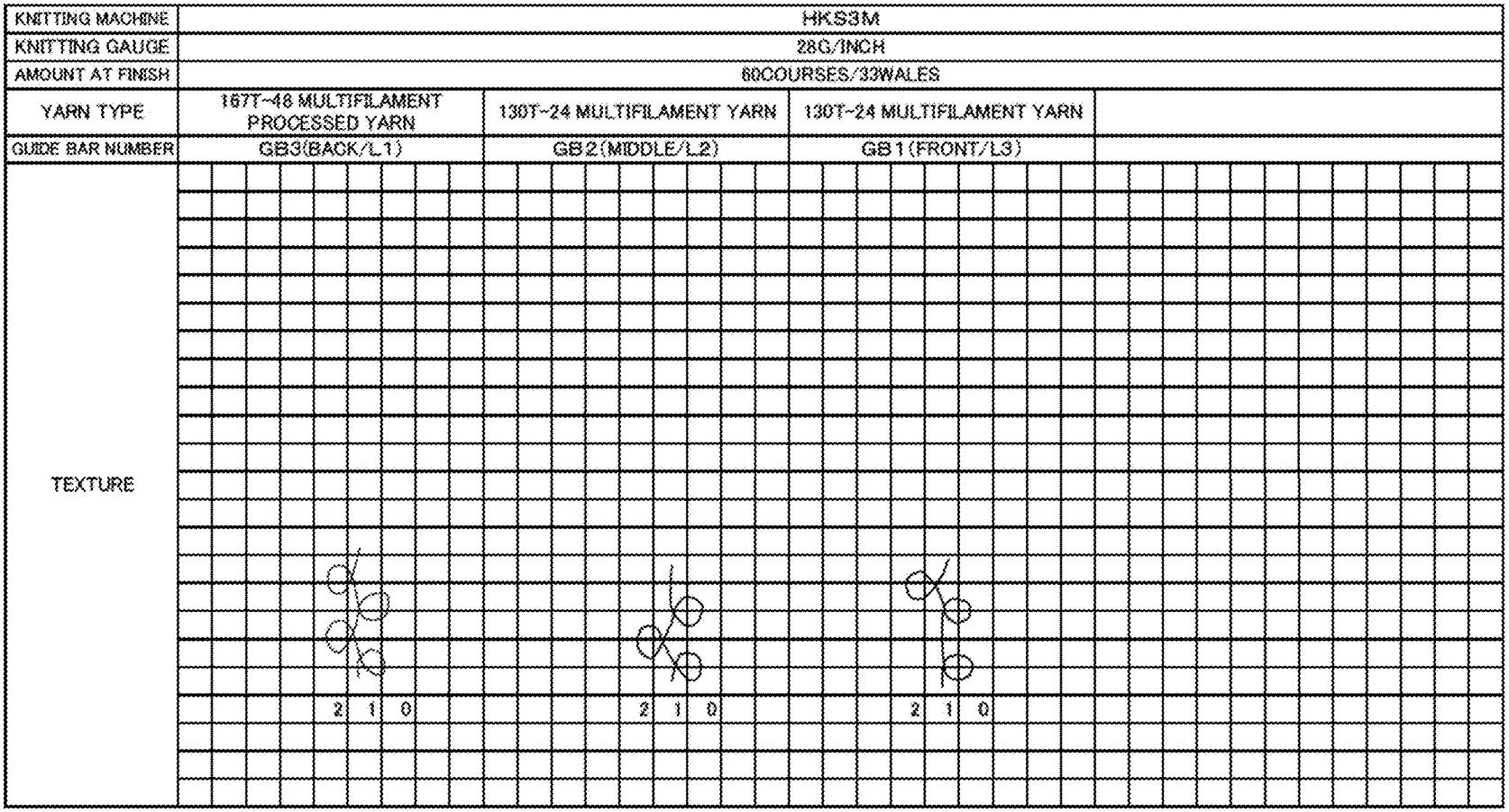

WARP KNITTED FABRIC AND MANUFACTURING METHOD THEREOF

TECHNICAL FIELD

The present invention relates to a warp knitted fabric having a woven fabric appearance, and a manufacturing method thereof.

BACKGROUND ART

Traditionally, in various fields of related art, there has been a demand for a knitted fabric having a woven fabric appearance, to be used for an application requiring a stretch characteristic, for example, clothing, interior materials, vehicle interior materials, etc. The knitted fabric having the woven fabric appearance may be, for example, a warp knitted fabric in which warps are inserted, a warp knitted fabric in which wefts are inserted, etc. However, there has been a problem in that the stretch characteristic is suppressed due to an insertion yarn by which the warp knitted fabric has the woven fabric appearance.

In order to solve the problem, Patent Document 1 describes that a warp knitted fabric is knitted by two or more guide bars by feeding a synthetic-fiber filament yarn A of a total 50 to 100 denier from one of a front guide bar and a back guide bar, and feeding a synthetic-fiber filament yarn B with a total denier of 40 to 60% of the synthetic-fiber filament yarn A from the other, and is subjected to a wrinkle processing. With this configuration, the warp knitted fabric of Patent Document 1 has an excellent stretchability while having the woven fabric appearance. However, since the warp knitted fabric of Patent Document 1 merely expresses the wefts of the fabric by floating sinker loops of the front yarn by performing the wrinkle processing on the tricot knitted fabric knitted by the two guide bars, the woven fabric appearance is insufficient, and the stretch characteristic is also insufficient. Further, since the tricot knitted fabric is knitted by the two guide bars, there is a problem in that, especially, the tear strength is degraded.

PRIOR ART DOCUMENT

[Patent Document]

Patent Document 1: Japanese Patent Laid-Open Publication No. 08-269851

DISCLOSURE OF THE INVENTION

Problem that the Invention is to Solve

The present invention provides a warp knitted fabric of which physical property needed for an application requiring the stretch characteristic, especially, tear strength is excellent while having a woven fabric appearance, and a manufacturing method thereof.

Means for Solving the Problem

The present invention provides a warp knitted fabric formed of yarns fed from at least three guide bars including front, middle, and back guide bars, in which a back yarn fed from the back guide bar forms a cord knit structure, a front yarn fed from the front guide bar and a middle yarn fed from the middle guide bar are arranged alternately in a weft direction, each of the front yarn and the middle yarn forms a stitch formation structure and an insertion structure alternately in a warp direction, the stitch formation structure of each of the front yarn and the middle yarn is a denbigh knit structure or a cord knit structure, and the insertion structure formed by the front yarn and the insertion structure formed by the middle yarn are arranged alternately at least in the warp direction so that the front yarn and the middle yarn are exposed alternately at least in the warp direction on sinker loops of the back yarn.

In this warp knitted fabric, it is preferable that the front yarn fed from the front guide bar and the middle yarn fed from the middle guide bar are arranged alternately in the weft direction. Further, it is preferable that each of the front yarn and the middle yarn forms the denbigh knit structure and the insertion structure alternately in the warp direction (i.e., it is preferable that the stitch formation structure is the denbigh knit structure).

In addition, in this warp knitted fabric, a ratio of the insertion structure exposed on a surface of the warp knitted fabric is preferably 15 to 60%.

In addition, the present invention provides a method of manufacturing the warp knitted fabric, using a warp knitting machine provided with at least three guide bars including front, middle, and back guide bars, knitting a cord knit structure by feeding a back yarn from the back guide bar, knitting a stitch formation structure and an insertion structure alternately in a warp direction by feeding a front yarn from the front guide bar, knitting a stitch formation structure and an insertion structure alternately in the warp direction by feeding a middle yarn from the middle guide bar, knitting a denbigh knit structure or a cord knit structure as the stitch formation structure of each of the front yarn and the middle yarn, and arranging the insertion structure formed by the front yarn and the insertion structure formed by the middle yarn alternately at least in the warp direction so as to expose the front yarn and the middle yarn alternately at least in the warp direction on sinker loops of the back yarn.

Advantage of the Invention

According to the warp knitted fabric and the manufacturing method thereof in the present invention, the insertion structures by the front yarn and the middle yarn are exposed alternately at least in the warp direction on the sinker loops of the back yarn, so that the design of the woven fabric may be provided. That is, the front yarn and the middle yarn in the insertion structures are exposed on the sinker loops formed by the back yarn so as to cover and hide the sinker loops, and as a result, the design of the woven fabric may be provided.

Further, the sinker loops of the back yarn fed from the back guide bar are pressed by the stitch formation structures (i.e., the denbigh knit structures or the cord knit structures) and the insertion structures formed by the front yarn and the middle yarn, so that the warp knitted fabric of which physical property needed for the application requiring the stretch characteristic, especially, tear strength is excellent may be provided.

Further, the stitch formation structure (i.e., the denbigh knit structure or the cord knit structure) and the insertion structure by each of the front yarn and the back yarn are formed alternately, so that the stretch in the warp direction is suppressed, and thus, the warp knitted fabric having an excellent stretch balance in the warp and weft directions may be provided.

Thus, according to the present invention, it is possible to provide a warp knitted fabric of which physical property needed for the application requiring the stretch characteristic, especially, tear strength is excellent while having the woven fabric appearance, and a manufacturing method thereof.

BRIEF DESCRIPTION OF THE DRAWINGS

FIGS. 2A to 2C are examples of a structure view of the warp knitted fabric according to the embodiment, in which FIG. 2A illustrates a case where a front yarn 1 and a middle yarn 2 are fed 1 in 1 out such that a denbigh knit structure and an insertion structure are formed alternately, FIG. 2B illustrates a case where the front yarn 1 and the middle yarn 2 are fed 2 in 2 out such that the denbigh knit structure and the insertion structure are formed alternately, and FIG. 2C illustrates a case where the front yarn 1 and the middle yarn 2 are fed 1 in 3 out such that the denbigh knit structure and the insertion structure are formed alternately.

FIGS. 4A and 4B are schematic enlarged cross-sectional views explaining a portion of the warp knitted fabric according to the embodiment, in which FIG. 4A illustrates a state where the front yarn 1 (or the middle yarn 2) is in contact with the back yarn 3, and FIG. 4B illustrates a state where the front yarn 1 (or the middle yarn 2) floats from the back yarn 3.

FIG. 5 is a structure view of Examples 1 and 6.

FIG. 6 is a structure view of Example 2.

FIG. 7 is a structure view of Example 3.

FIG. 8 is a structure view of Example 4.

FIG. 9 is a structure view of Example 5.

FIG. 10 is a structure view of Example 7.

FIG. 11 is a structure view of Example 8.

FIG. 12 is a structure view of Comparative Example 1.

FIG. 13 is a structure view of Comparative Example 2.

BEST MODE FOR CARRYING OUT THE INVENTION

The present embodiment provides a warp knitted fabric formed of yarns fed from at least three guide bars including front, middle, and back guide bars, in which a back yarn fed from the back guide bar forms a cord knit structure, a front yarn fed from the front guide bar and a middle yarn fed from the middle guide bar are arranged alternately in a weft direction, each of the front yarn and the middle yarn forms a stitch formation structure and an insertion structure alternately in a warp direction, the stitch formation structure of each of the front yarn and the middle yarn is a denbigh knit structure or a cord knit structure, and the insertion structure formed by the front yarn and the insertion structure formed by the middle yarn are arranged alternately at least in the warp direction so that the front yarn and the middle yarn are exposed alternately at least in the warp direction.

The warp knitted fabric of the present embodiment may be a tricot knitted fabric, a single Raschel knitted fabric or the like.

Figure 1:
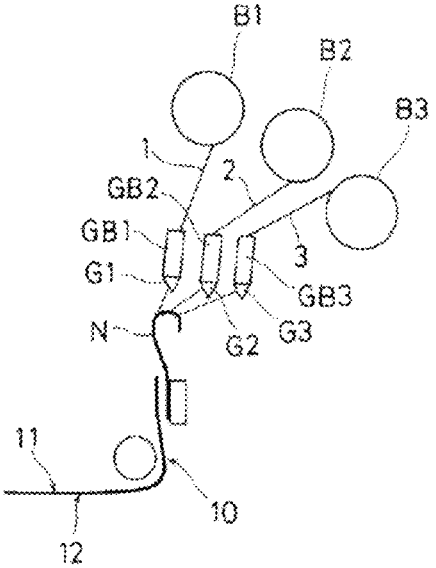
FIG. 1 is a schematic view illustrating a main portion of a warp knitting machine used for knitting a warp knitted fabric according to an embodiment.

The warp knitted fabric of the present embodiment is knitted by a 16- to 40-gauge warp knitting machine provided with at least three guide bars, for example, one front guide bar GB1, one middle guide bar GB2, and one back guide bar GB3 as schematically illustrated in FIG. 1. Especially, an 18-to 36-gauge warp knitting machine is preferable. When the number of gauges is 16 or more, a loop in a width direction is small, and thus, it is difficult for the insertion structure to float, so that the anti-pilling property is hardly damaged. When the number of gauges is 40 or less, the stretch of the knitted fabric is large, so that wrinkles are hardly formed. The warp knitting machine described above may be a tricot knitting machine, a Raschel knitting machine or the like.

FIG. 1 illustrates a main portion of a tricot knitting machine that is a kind of the warp knitting machine, in which N indicates multiple knitting needles arranged in parallel in the width direction of the knitting machine, GB1 to GB3 indicate the respective guide bars used for knitting, G1 to G3 indicate guide portions through which the knitting yearns including the front yarn, the middle yarn, and the back yarn are threaded, and B1 to B3 indicate beams of the respective knitting yarns. Further, in the drawing, the reference numeral 1 indicates the front yarn, the reference numeral 2 indicates the middle yarn, and the reference numeral 3 indicates the back yarn.

In the present embodiment, the fiber used as the front and middle yarns is not particularly limited. A polyester fiber is preferable in view of a physical property.

A form of the yarns used for the front and middle yarns is not also particularly limited. Any of spun yarns and filament yarns may be used. In addition, as the filament yarns, any of monofilament yarns and multifilament yarns may be used. In addition, processed yarns which are obtained by post-processing the filament yarns may be used. The form of the yarns may be appropriately set according to an application. In addition, when a yarn with a functional property (e.g., a water-absorptive yarn) is used, the functional property may be provided, and when a yarn having a high design property (e.g., a lame or chenille yarn) is used, the design property may be provided.

A fineness of the yarns used for the front and middle yarns is preferably 56 to 330 dtex, and more preferably 84 to 220 dtex. When the fineness of the yarns is 56 dtex or higher, the design of the woven fabric by the insertion structure is hardly damaged, and further, the strength is hardly damaged. When the fineness of the yarns is 330 dtex or lower, the feeling of the knitted fabric hardly becomes rough and hard, and further, the anti-snagging property is hardly damaged.

The fiber used as the back yarn is not particularly limited. A polyester fiber is preferable in view of a physical property.

The form of the yarn used for the back yarn is not also particularly limited. Any of a spun yarn and a filament yarn may be used. In addition, as the filament yarn, any of a monofilament yarn and a multifilament yarn may be used. In addition, a processed yarn which is obtained by post-processing the filament yarn may be used. The form of the yarn may be appropriately set according to an application.

The fineness of the yarn used for the back yarn is preferably 56 to 440 dtex, and more preferably 84 to 220 dtex. When the fineness of the yarn is 56 dtex or higher, the swelling of the sinker loops is sufficient so that the knitted fabric hardly becomes see-through, and further, the strength is hardly damaged. When the fineness of the yarn is 440 dtex or less, the feeling of the knitted fabric hardly becomes rough and hard, and the stretch characteristic is hardly deteriorated.

In the knitting of the warp knitted fabric of the present embodiment, for example, when the knitting is performed by the tricot knitting machine provided with the three bars GB1 to GB3, the so-called back guide bar GB3 on the rear side of the knitting machine (the side where the position of the guide bar becomes closest to the row of the knitting needles at the time of underlapping) is used as a base guide bar that feeds the back yarn. The back guide bar GB3 knits the cord knit structure in which the back yarn forms stitches (looping) while underlapping to the left and the right alternately in each course.

Further, at least two guide bars arranged in front of the back guide bar GB3, for example, the front guide bar GB1 and the middle guide bar GB2 are used as guide bars that feed the front yarn and the middle yarn. Each of the front guide bar GB1 and the middle guide bar GB2 knits the stitch formation structure, in which each yarn forms stitches while underlapping to the left and the right alternately in each course, and the insertion structure alternately in the warp direction. Here, the stitch formation structure of each of the front yarn and the middle yarn is the denbigh knit structure or the cord knit structure. Accordingly, each of the front guide bar GB1 and the middle guide bar GB2 knits the denbigh knit structure and the insertion structure alternately in the warp direction or the cord knit structure and the insertion structure alternately in the warp direction.

As a result, on the sinker loops of the back yarn, the insertion structures of the front yarn and the middle yarn are knitted across the sinker loops of the back yarn at predetermined intervals in the course direction (warp direction), so that the design of the woven fabric is provided. Further, the stitch formation structures of the front yarn and the middle yarn (i.e., the denbigh knit structures or the cord knit structures) are knitted as base structures together with the back yarn, so that the strength is improved.

In the case of the present embodiment, in the knitting described above, the front yarn fed by the front guide bar GB1 and the middle yarn fed by the middle guide bar GB2 are arranged alternately in the weft direction. Specifically, in the two guide bars including the front guide bar GB1 and the middle guide bar GB2, a row set for yarn-in of the front yarn is also set for yarn-out of the middle yarn, and a row set for yarn-in of the middle yarn is also set for yarn-out of the front yarn, such that it is important that yarn-in of the front yarn and yarn-in of the middle yarn are not performed in the same row. There may be a row set for both yarn-out of the front yarn and yarn-out of the middle yarn.

In addition, the terms "the front yarn and the middle yarn are arranged alternately in the weft direction" mean not only that one front yarn and one middle yarn are arranged alternately in the weft direction, but also that one or multiple front yarns continuously arranged in the weft direction and one or multiple middle yarns continuously arranged in the weft direction are arranged alternately in the weft direction. Accordingly, for example, two front yarns continuously arranged in the weft direction and two middle yarns continuously arranged in the weft direction may be arranged alternately in the weft direction.

In addition, when each of the front yarn and the middle yarn forms the cord knit structure and the insertion structure alternately, it is important that yarn-out is performed, for example, in a X-in (X+$\alpha$)-out pattern (a is 0 or a natural number), to suppress the insertion structure of one side from being pressed by the cord knit structure of the other side. That is, it is important that 1 or more yarn-out is performed for 1 yarn-in. For example, it is important that when 3 yarn-in is performed, 3 or more yarn-out is performed such that 3 in 3 out, 3 in 4 out, or 3 in 5 out, etc. is performed. Here, a is preferably an even number, and more preferably 0 or 2. When a is an even number, the insertion structures are hardly biased to the left or right, so that the appearance of the woven fabric becomes satisfactory. Further, when a is 2 or lower, a sufficient number of the insertion yarns across the sinker loops of the back yarn are secured, so that the appearance of the woven fabric becomes satisfactory.

Since the front yarn fed by the front guide bar GB1 and the middle yarn fed by the middle guide bar GB2 are arranged alternately in the weft direction, the front yarn and the middle yarn are arranged alternately in the width direction (the weft direction) in the obtained warp knitted fabric.

In addition, the front yarn fed from the front guide bar GB1 knits a stitch formation structure (i.e., the denbigh knit structure or the cord knit structure) 18 and an insertion structure 20 alternately in the warp direction. Further, as well-known, the denbigh knit structure or the cord knit structure is a knit structure in which each yarn forms stitches while underlapping to the left and the right alternately in each course, across several courses in the knitting direction. Similarly, the middle yarn fed from by the middle guide bar GB2 also knits a stitch formation structure 19 and an insertion structure 21 alternately in the warp direction. It is important that the insertion structure 20 formed by the front yarn and the insertion structure 21 formed by the middle yarn are arranged alternately in the course direction (the warp direction). By this arrangement and the above-described arrangement (i.e., the alternate arrangement of the front yarn and the middle yarn in the weft direction), the portions of the insertion structure 20 of the front yarn and the insertion structure 21 of the middle yarn are not pressed by the opposing portions of the denbigh knit structure or the cord knit structure 18 and the denbigh knit structure or the cord knit structure 19, and are exposed alternately on the surface of the warp knitted fabric, so that especially, the satisfactory appearance of the woven fabric may be obtained.

In the stitch formation structures (i.e., the denbigh knit structures or the cord knit structures) formed by the front yarn and the middle yarn, it is important that the number of underlaps is 1 or more needles, and preferably, 1 to 3 needles. When the number of underlaps is 1 or more needles, the tear strength or the stretch characteristic is hardly damaged. In addition, a case where "the number of underlaps is less than one needle" corresponds to a case where knitting is made with the same knitting needle in the course direction, that is, a chain stitch structure is knitted. In addition, when the number of underlaps is 3 or less needles, the design of the woven fabric is hardly damaged, and the feeling of the knitted fabric hardly becomes rough and hard. In addition, it is preferable that the number of underlaps in the stitch formation structures (i.e., the denbigh knit structures or the cord knit structures) formed by the front yarn and the middle yarn is the same, from the viewpoint that the front yarn and the middle yarn mutually expose the insertion structures.

It is important that the number of courses in which the stitch formation structure (i.e., the denbigh knit structure or the cord knit structure) and the insertion structure formed by each of the front yarn and the middle yarn are continuously knitted is 1 or more, preferably 1 to 5, and more preferably 1 to 3. When the number of continuously knitted courses is 5 or less, the anti-snagging property is hardly deteriorated.

Figure 2A:
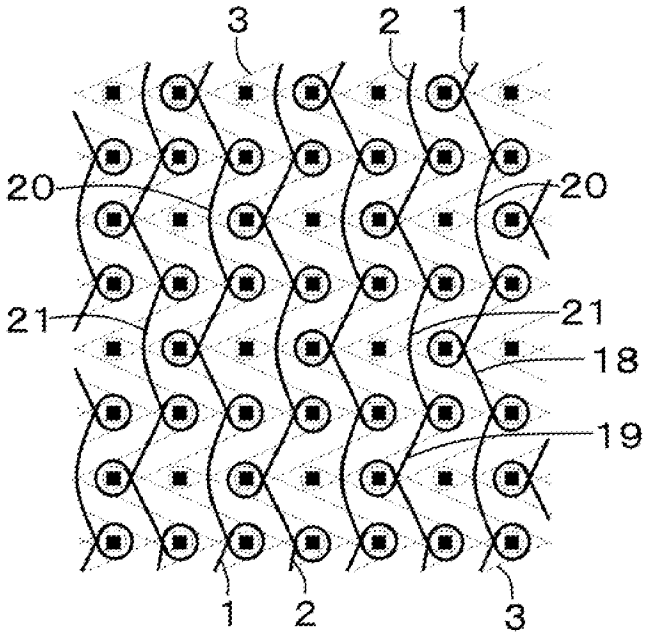
Figure 2B:
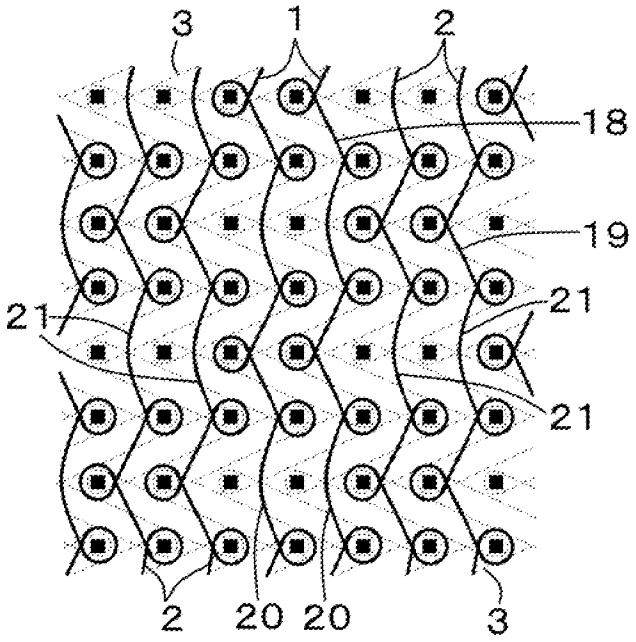
Figure 2C:
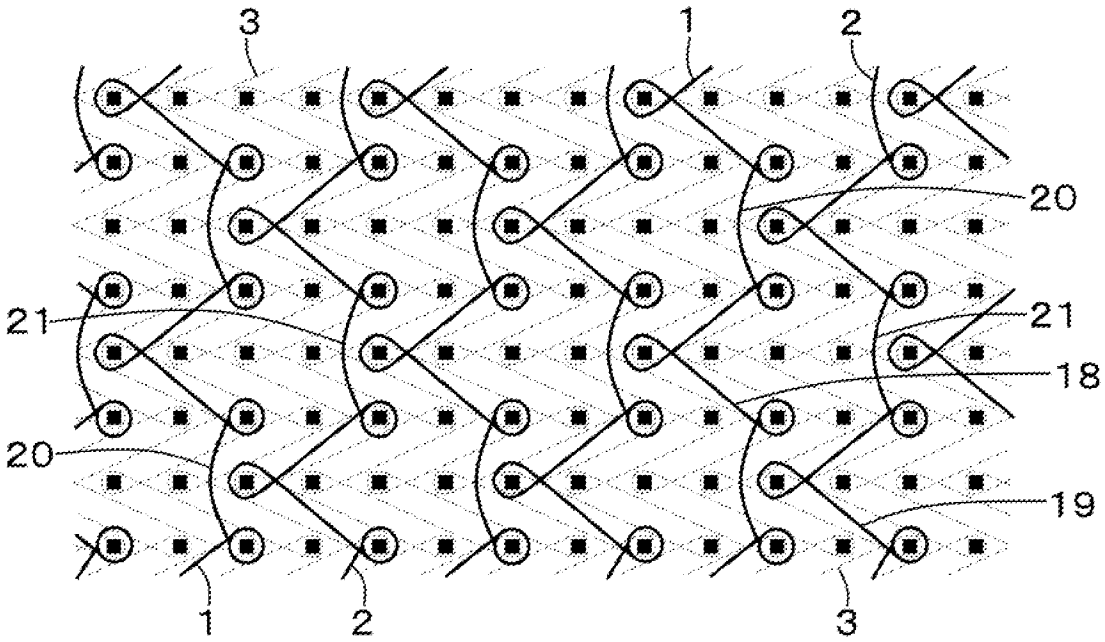
Figure 3:
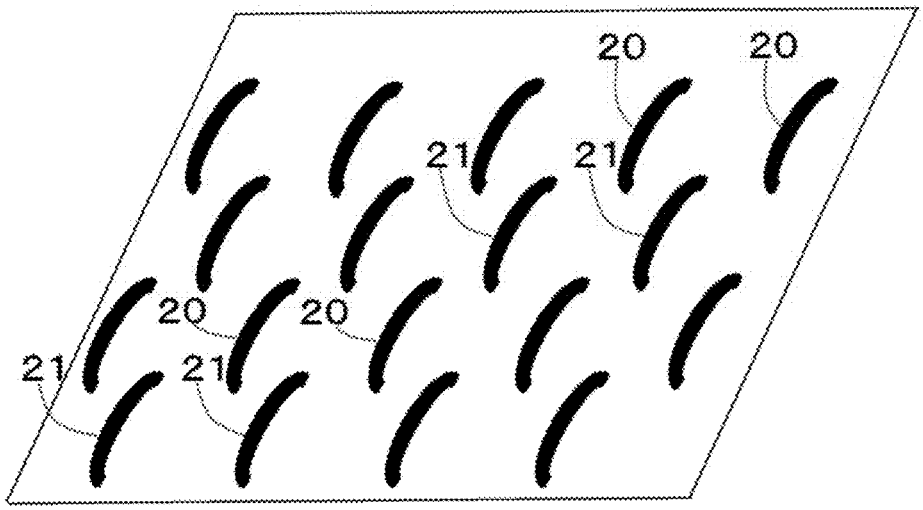
FIG. 3 is a schematic perspective view of an example of the warp knitted fabric according to the embodiment.

FIGS. 2A to 2C illustrate examples of structure views of the warp knitted fabric which is knitted as described above. In FIGS. 2A to 2C, the back yarn 3 is drawn in a dashed line, and the front yarn 1 and the middle yarn 2 are drawn in solid lines. In the knit structures of FIGS. 2A to 2C, the back yarn 3 is fed in a full set to form the cord knit structure. In addition, in the knit structure of FIG. 2A, the front yarn 1 and the middle yarn 2 are fed 1 in 1 out to form the denbigh knit structure and the insertion structure alternately. In addition, in the knit structure of FIG. 2B, the front yarn 1 and the middle yarn 2 are fed 2 in 2 out to form the denbigh knit structure and the insertion structure alternately. In addition, in the knit structure of FIG. 2C, the front yarn 1 and the middle yarn 2 are fed 1 in 3 out to form the denbigh knit structure and the insertion structure alternately.

As a result of the knitting described above, a portion 20 of the insertion structure of the front yarn 1 and a portion 21 of the insertion structure of the middle yarn 2 are exposed on the surface of the warp knitted fabric as illustrated in FIGS. 2A to 2C and 3. Since the portions 20 and 21 of the insertion structures are periodically arranged at intervals in the warp direction and the weft direction, the warp knitted fabric exhibits the especially satisfactory appearance of the woven fabric.

It is preferable that an overlap of a needle loop in the denbigh knit structure or the cord knit structure 18 formed by the front yarn and an overlap of a needle loop in the denbigh knit structure or the cord knit structure 19 formed by the middle yarn are toward the same direction in the same order in one repeat of the knit structure. For example, when the overlap is formed in an order of the right, left, and right directions in one repeat of the knit structure of the front yarn, the overlap in one repeat of the knit structure of the middle yarn is also formed in the order of the right, left, and right directions. Similarly, it is preferable that an underlap of a sinker loop in the denbigh knit structure or the cord knit structure 18 formed by the front yarn and an underlap of a sinker loop in the denbigh knit structure or the cord knit structure 19 formed by the middle yarn are toward the same direction in the same order in one repeat of the knitted structure. By satisfying the conditions described above, the insertion structure 20 and the insertion structure 21 are easily exposed on the surface of the warp knitted fabric, so that the appearance of the woven fabric may be easily obtained. At this time, the needle loop may be any of a closed stitch and an opened stitch.

Figure 4A:
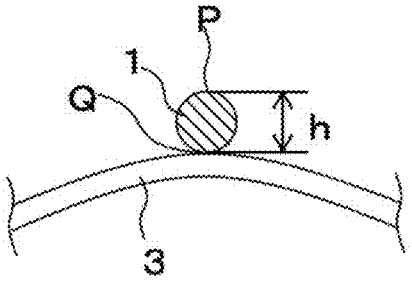
Figure 4B:
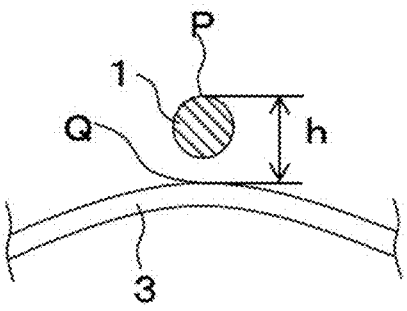

The height of the insertion structure exposed on the surface of the warp knitted fabric is preferably 0.1 to 2.0 mm, and more preferably 0.2 to 1.2 mm. When the height of the insertion structure is 0.1 mm or higher, the strength, especially, the tear strength is hardly damaged. When the height of the insertion structure is 2.0 mm or lower, the feeling of the knitted fabric hardly becomes rough and hard, and the anti-snagging property is hardly damaged. Here, the height of the insertion structure refers to the height indicated by the reference numeral "h" in FIGS. 4A and 4B, and indicates a difference of height between a summit P of the front yarn 1 (or the middle yarn 2) in the insertion structure and a sinker loop summit Q of the cord knit structure formed by the back yarn 3.

Here, the height of the insertion structure exposed on the surface of the warp knitted fabric is the height of the insertion structure which is measured by a method of an Example described hereinbelow.

The ratio of the insertion structure exposed on the surface of the warp knitted fabric is preferably 15 to 60%, and more preferably 25 to 50%. When the ratio of the insertion structure is 15% or more, the appearance of the woven fabric is easily obtained, and the feeling of the knitted fabric hardly becomes rough and hard. When the ratio of the insertion structure is 60% or less, the strength is hardly damaged, and the anti-snagging property is hardly damaged.

Here, the ratio of the insertion structure exposed on the surface of the warp knitted fabric may be calculated as follows.

Insertion structure ratio(%)=sum of the number of courses of the insertion structures exposed in a 25.4 mm square/(course density×wale density)×100

In addition, the course density is the number of courses per 25.4 mm, and the wale density is the number of wales per 25.4 mm.

The knit structure formed by the back yarn fed by the back guide bar GB3 is the cord knit structure in view of the design and the strength. The number of underlaps in the cord knit structure is preferably 2 to 7 needles, and more preferably 3 to 5 needles. When the number of underlaps is 2 or more needles, the superimposition of the sinker loops formed by the back yarn is sufficient, and thus, the obtained knitted fabric hardly becomes see-through, so that the design property is hardly damaged, and the tear strength is hardly damaged. When the number of underlaps is 7 or less needles, the feeling of the knitted fabric hardly becomes rough and hard, and the stretch of the knitted fabric is large so that wrinkles hardly occur.

The density of the warp knitted fabric is preferably 20 to 100 courses/25.4 mm and 16 to 60 wales/25.4 mm, and more preferably 30 to 70 courses/25.4 mm and 20 to 50 wales/25.4 mm. When the density is 20 or more courses/25.4 mm and 16 or more wales/25.4 mm, the knitted fabric hardly becomes see-through so that the design property is not damaged, and the shape retention property is hardly damaged. Further, since the intervals of the insertion structures are narrow so that the insertion yarn hardly floats and moves, the anti-snagging property is hardly damaged. When the density is 100 or less courses/25.4 mm and 60 or less wales/25.4 mm, the feeling of the knitted fabric hardly becomes rough and hard, and the stretch of the knitted fabric is large so that wrinkles are hardly formed.

The tear strength of the warp knitted fabric is preferably 70 N or more, more preferably 150 N or more, and still more preferably 220 N or more. When the tear strength is 70 N or more, the knitted fabric is hardly torn during the use thereof. The upper limit value of the tear strength is not particularly limited, but is preferably 250 N or less. When the tear strength is 250 N or less, the feeling of the knitted fabric hardly becomes rough and hard, and the knitted fabric is light and easy to handle. Here, the tear strength is the tear strength which is measured by a method of an Example described hereinbelow.

The stretch of the warp knitted fabric is preferably 5 N/25.4 mm or more in both the warp direction and the weft direction, and more preferably 15 N/25.4 mm or more in the warp direction and 50 N/25.4 mm or more in the weft direction. Still more preferably, the stretch is 15 N/25.4 mm or more in the warp direction and 50 N/25.4 mm or more in the weft direction, and the stretch ratio in the warp and weft (lateral/longitudinal) directions is in the range of 0.5 to 2.0. When the stretch is 5 N/25.4 mm or more in both the warp direction and the weft direction, the tension or elasticity of the knitted fabric is hardly reduced so that wrinkles are hardly formed. Here, the stretch is the stretch which is measured by a method of an Example described hereinbelow.

The weight of the warp knitted fabric is preferably in the range of 180 to 360 g/m$^2$, more preferably in the range of 200 to 320 g/m$^2$, and still more preferably in the range of 240 to 280 g/m$^2$. When the weight is 180 g/m$^2$ or more, the knitted fabric is hardly torn during the use thereof, and the desired design is easily obtained. When the weight is 360 g/m$^2$ or less, the feeling of the knitted fabric hardly becomes rough and hard, and the knitted fabric is light and easy to handle.

In addition, in the present embodiment, instead of the knitting using the above-described warp knitting machine of three guide bars, the knitting may be performed using a knitting machine of four or more guide bars (i.e., a knitting machine having four or more guide bars). For example, in addition to the front guide bar that feeds the front yarn, the middle guide bar that feeds the middle yarn, and the back guide bar that feeds the back yarn, one or multiple base guide bars may be provided behind the back guide bar, such that the front yarn and the middle yarn are knitted to be exposed alternately in the warp direction on the sinker loops of the back yarn in the same manner as described above. In addition, in the knitting machine of four or more guide bars, multiple middle guide bars may be provided to feed middle yarns, such that the front yarn and the multiple middle yarns are knitted to be exposed alternately in the warp direction on the sinker loops of the back yarn.

The obtained warp knitted fabric may be subjected to a well-known post-processing of related art (dyeing, heat setting, etc.).

EXAMPLES

Hereinafter, the present embodiment will be described in more detail using Examples, but the present invention is not limited to the Examples. In addition, the obtained warp knitted fabric was evaluated according to the following methods.

[Design Property]

The obtained warp knitted fabric was evaluated according to the following evaluation criteria.

(Evaluation Criteria)

A: Look like woven fabric

B: Substantially look like woven fabric

C: Substantially look like woven fabric but loops appear

D: Do not look like woven fabric

[Stretch Characteristic]

The obtained warp knitted fabric was evaluated according to the following evaluation criteria.

In order to measure a 5% circular modulus in the warp direction and the weft direction, three circular test pieces each having a size of a 300 mm diameter were collected in each of the directions.

Each test piece was put in a low-speed stretch-type tensile tester (Autograph AG-1, manufactured by Shimadzu Corporation) in which the gripping distance was 200 mm. The size of each of the upper and lower gripping jigs was 25.4 mm long×25.4 mm wide on the front side of the jig, and 25.4 mm long×50.8 mm wide on the back side of the jig. At this time, the initial load was set to 0.98 N.

Each put test piece was pulled at a tensile speed of 200 mm/min to be stretched up to a 20%, so that a load-stretch curve was obtained.

From the obtained load-stretch curve, the load at the time of a 5% stretch (N/25.4 mm) was obtained.

For each direction, an average value of the three test pieces was set as the value of the 5% circular modulus, and an evaluation was performed according to the following evaluation criteria.

(Evaluation Criteria)

A: 15 N/25.4 mm or more in the warp direction, 50 N/25.4 mm or more in the weft direction, and the warp/weft ratio in the range of 0.5 to 2.0

B: 15 N/25.4 mm or more in the warp direction, 50 N/25.4 mm or more in the weft direction C: 5 N/25.4 mm or more and less than 15 N/25.4 mm in the warp direction, and 5 N/25.4 mm or more and less than 50 N/25.4 mm in the weft direction D: less than 5 N/25.4 mm in any one of the warp•weft directions

[Tear Strength]

Five test pieces were prepared each having a size of a 50 mm width and a 250 mm length in which the length direction is set as the warp direction. An isosceles trapezoid mark having a short side of 100 mm and a long side of 150 mm was attached to each test piece, and a 10 mm incision was formed at the center of the short side of the mark to be perpendicular to the short side.

Each test piece was put in the low-speed stretch-type tensile tester in which the gripping distance was 100 mm. At this time, the short side of the trapezoid was pulled and the long side thereof was gripped loosely. The test piece was torn at a tensile speed of 200 mm/min to measure the strength. The tear strength was expressed by an average value N.

The minimum value among the five test pieces was taken as the tear strength, and the evaluation was performed according to the following evaluation criteria.

(Evaluation Criteria)

A: 220 N or more

B: 150 N or more and less than 220 N

C: 70 N or more and less than 150 N

D: less than 70 N

[Anti-Snagging Property]

Two test pieces each having a size of a 330 mm width and a 200 mm length were prepared in the respective warp and weft directions. The test pieces were sewn together at positions 30±2.5 mm apart from the ends thereof in the width direction to have a cylindrical shape, while the surfaces of the pieces face inward.

The sewn cylindrical test pieces were turned inside out such that the surfaces of the pieces face outward, and put in a drum of a tester. For the tester, the ICI mace snag tester (manufactured by Atlas) defined in ASTM D3939 was used. The mass of the mace was 160 g. The position of a contact was adjusted using a gauge attached to the tester, the drum was revolved 600 times, and then, the test pieces were removed. At this time, the test pieces in the respective warp and weft directions were evaluated for each of a case where the drum was revolved forward and a case where the drum was revolved reverse.

The test pieces were compared with standard samples of the ICI in the observation box to determine the grade. The worst value of the test pieces in the respective warp and weft directions was taken as the anti-snagging property, and the evaluation was performed according to the following evaluation criteria.

(Evaluation Criteria)

A: Third grade or higher

B: Second grade or higher and lower than third grade

C: Lower than second grade

[Difference of Height of Insertion Structure]

The cross-section of the warp knitted fabric in the width direction was observed with a microscope (digital HF microscope VH-8000, manufactured by Keyence Corporation), and the height difference between the insertion yarn of the insertion structure and the summit of a sinker loop of the back yarn was measured.

Example 1

A tricot knitted fabric was knitted using a 28-gauge tricot knitting machine (HKS3M: manufactured by Karl Mayer Corporation). Specifically, as illustrated in FIG. 5, a polyester multifilament yarn of 130 dtex/24f was introduced 1 in 1 out (1 yarn-in 1 yarn-out) as the front yarn to the front guide bar GB1 to form the denbigh knit structure and the insertion structure alternately, a polyester multifilament yarn of 130 dtex/24f was introduced 1 in 1 out (1 yarn-in 1 yarn-out) as the middle yarn to the middle guide bar GB2 to form the denbigh knit structure and the insertion structure alternately, and a full set of a polyester multifilament processed yarn of 167 dtex/48f was introduced as the back yarn to the back guide bar GB3 to form the cord knit structure. At this time, the overlap direction of the needle loop in the denbigh knit structure formed by the front yarn was the same as the overlap direction of the needle loop in the denbigh knit structure formed by the middle yarn. In addition, the number of courses in which the insertion yarn of the inversion structure is continuously exposed on the surface of the warp knitted fabric was 1.

The obtained tricot knitted fabric was subjected to a presetting at 190° C. for one minute in a heat setter, then was dyed and dried at 130° C., and then was subjected to a final setting at 150° C. for one minute in the heat setter, so that the tricot knitted fabric with 48 courses/25.4 mm and 32 wales/25.4 mm was manufactured as a finished tricot knitted fabric. At this time, the ratio of the insertion structure exposed on the surface of the warp knitted fabric was 25%, and the height of the insertion yarn was 0.3 mm. In addition, the design property of the obtained warp knitted fabric was "B", the stretch characteristic was "A", the tear strength was "A", and the anti-snagging property was "B".

Examples 2 to 8 and Comparative Examples 1 and 2

Warp knitted fabrics of Examples 2 to 8 and Comparative Examples 1 and 2 were obtained according to the conditions illustrated in Tables 1-3 and FIGS. 5 to 13 in the same manner as that in Example 1.

In addition, among the Examples, Examples 1 to 6 and 8 are Examples where the lengths of the insertion portions of the front yarn and the middle yarn (the number of courses of the insertion portions) are the same, and Example 7 is an Example where the lengths of the insertion portions of the front yarn and the middle yarn are different from each other.

In addition, among the Examples, Examples 1, 2, and 5 to 8 are Examples where there exists a course in which both the front yarn and the middle yarn are knitted into the base structure (a course which is not an insertion portion), and Examples 3 and 4 are Examples where there exists no course in which both the front yarn and the middle yarn are knitted into the base structure. Further, among the Examples, Examples 5 and 8 are Examples where there exist two or more continuous courses in which both the front yarn and the middle yarn are knitted into the base structure, and more specifically, Examples where there exist three continuous courses in which both the front yarn and the middle yarn are knitted into the base structure.

In addition, among the Examples, Examples 1 to 4, 6, and 7 are Examples where the insertion portions of the front yarn and the middle yarn are arranged alternately with no intervals in the course direction, in view of the appearance of the warp knitted fabric, and Examples 5 and 8 are Examples where the insertion portions of the front yarn and the middle yarn are arranged alternately at intervals in the course direction, in view of the appearance of the warp knitted fabric.

Tables 1-3 represent the evaluation results.

TABLE 1

| | | | Example 1 | Example 2 | Example 3 | Example 4 |
|---|---|---|---|---|---|---|
| Knitting Machine | | | HKS3M | HKS3M | HKS3M | HKS3M |
| Gauge | | | 28 | 28 | 28 | 28 |
| Knit Texture | Front Body | Yarn | PET Multifilament Yarn | PET Multifilament Yarn | PET Multifilament Yarn | PET Multifilament Yarn |
| | | Fineness | 130/24 | 130/24 | 130/24 | 130/24 |
| | | Yarn Arrangement | 1in 1out | 1in 3out | 1in 1out | 1in 1out |
| | | Knit Texture | 1-0/1-1/1-0/1-2 | 1-0/1-1/1-0/2-3 | 1-1/1-1/1-1/ 1-0/1-2/1-0 | 1-1/1-1/1-1/1-1/ 1-0/1-2/1-0/1-1 |
| | | Knit Texture | Denbigh | Cord (2 Needles) | Denbigh | Denbigh |
| | | Overlap Direction | RightRightLeft (RRL) | RRL | RLR | RLR |
| | | Number of Courses (Base Texture) | 3 | 3 | 3 | 3 |
| | | Number of Courses (Insertion Texture) | 1 | 1 | 3 | 5 |
| | Middle Body | Yarn | PET Multifilament Yarn | PET Multifilament Yarn | PET Multifilament Yarn | PET Multifilament Yarn |
| | | Fineness | 130/24 | 130/24 | 130/24 | 130/24 |
| | | Yarn Arrangement | 1out 1in | 3out 1in | 1out 1in | 1out 1in |
| | | Knit Texture | 1-0/1-2/1-0/1-1 | 1-0/2-3/1-0/1-1 | 1-0/1-2/1-0/1-1/ 1-1/1-1 | 1-0/1-2/1-0/1-1/ 1-1/1-1/1-1/1-1 |
| | | Knit Texture | Denbigh | Cord (2 Needles) | Denbigh | Denbigh |
| | | Overlap Direction | RLR | RLR | RLR | RLR |
| | | Number of Courses (Base Texture) | 3 | 3 | 3 | 3 |
| | | Number Of Courses (Insertion Texture) | 1 | 1 | 3 | 5 |

TABLE 1-continued

| | | | Example 1 | Example 2 | Example 3 | Example 4 |
|---|---|---|---|---|---|---|
| | Back Body | Yarn | PET Multifilament Processed Yarn | PET Multifilament Processed Yarn | PET Multifilament Processed Yarn | PET Multifilament Processed Yarn |
| | | Fineness | 167/48 | 167/48 | 167/48 | 167/48 |
| | | Yarn Arrangement | Full Set | Full Set | Full Set | Full Set |
| | | Knit Texture | Cord (3 Needles) 1-0/5-4 | Cord (6 Needles) 1-0/8-7 | Cord (3 Needles) 1-0/3-4 | Cord (3 Needles) 1-0/3-4 |
| Warp Knitted Fabric | Weight ($g/m^2$) | | 250 | 360 | 270 | 280 |
| | Density | Courses | 48 | 34 | 53 | 60 |
| | | Wales | 32 | 32 | 34 | 34 |
| | Insertion Texture | Height (mm) | 0.3 | 0.5 | 0.7 | 1 |
| | | Exposure Ratio (%) | 25% | 25% | 50% | 63% |
| Evaluation | Design Properly | | A | B | B | B |
| | Stitch Characteristic | | A | C | B | B |
| | Tear Strength | | A | A | B | B |
| | Anti-Snagging Properly | | A | A | B | B |

20

TABLE 2

| | | | Example 5 | Example 6 | Example 7 | Example 8 |
|---|---|---|---|---|---|---|
| | Knitting Machine | | HKS3M | HKS3M | HKS3M | HKS3M |
| | Gauge | | 28 | 28 | 28 | 28 |
| Knit Texture | Front Body | Yarn | PET Multifilament Yarn | PET Multifilament Yarn | PET Multifilament Yarn | PET Multifilament Yarn |
| | | Fineness | 130/24 | 130/24 | 130/24 | 130/24 |
| | | Yarn Arrangement | 1in 1out | 2in 2out | 1in 1out | 1in 1out |
| | | Knit Texture | 1-0/1-2/1-0/1-1/ 1-0/1-2/1-0/1-2 Denbigh | 1-0/1-1/1-0/1-2 | 1-0/1-2/1-0/1-2/ 1-0/1-1 | 1-0/1-1/1-1/1-1/ 1-0/1-2/1-0/1-2/ 1-0/1-2/1-0/1-2 |
| | | Knit Texture | | Denbigh | Denbigh | Denbigh |
| | | Overlap Direction | RLR RLRL | RRL | RLRLR | RRLRLRLRL |
| | | Number of Courses (Base Texture) | 7 | 3 | 5 | 9 |
| | | Number of Courses (Insertion Texture) | 1 | 1 | 1 | 3 |
| | Middle Body | Yarn | PET Multifilament Yarn | PET Multifilament Yarn | PET Multifilament Yarn | PET Multifilament Yarn |
| | | Fineness | 130/24 | 130/24 | 130/24 | 130/24 |
| | | Yarn Arrangement | 1out 1in | 2out 2in | 1out 1in | 1out 1in |
| | | Knit Texture | 1-0/1-2/1-0/1-2/ 1-0/1-2/1-0/1-1 | 1-0/1-2/1-0/1-1 | 1-0/1-1/1-1/1-1/ 1-0/1-2 | 1-0/1-2/1-0/1-2/ 1-0/1-2/1-0/1-1/ 1-1/1-1/1-0/1-2 |
| | | Knit Texture | Denbigh | Denbigh | Denbigh | Denbigh |
| | | Overlap Direction | RLRLRLR | RLR | RRL | RLRLRLRRL |
| | | Number of Courses (Base Texture) | 7 | 3 | 3 | 9 |
| | | Number Of Courses (Insertion Texture) | 1 | 1 | 3 | 3 |
| | Back Body | Yarn | PET Multifilament Processed Yarn | PET Multifilament Processed Yarn | PET Multifilament Processed Yarn | PET Multifilament Processed Yarn |
| | | Fineness | 167/48 | 167/48 | 167/48 | 167/48 |
| | | Yarn Arrangement | Full Set | Full Set | Full Set | Full Set |
| | | Knit Texture | Cord (3 Needles) | Cord (3 Needles) 1-0/3-4 | Cord (3 Needles) 1-0/3-4 | Cord (3 Needles) 1-0/3-4 |
| Warp Knitted Fabric | Weight ($g/m^2$) | | 270 | 1-0/3-4 | 280 | 280 |
| | Density | Courses | 38 | 48 | 48 | 48 |
| | | Wales | 32 | 32 | 32 | 32 |
| | Insertion Texture | Height (mm) | 0.3 | 0.4 | 0.6 | 0.8 |
| | | Exposure Ratio (%) | 13% | 25% | 33% | 25% |
| Evaluation | Design Properly | | B | B | B | B |
| | Stitch Characteristic | | C | A | B | B |
| | Tear Strength | | A | A | B | A |
| | Anti-Snagging Properly | | A | A | B | B |

TABLE 3

| | | | Comparative Example 1 | Comparative Example 2 |
|---|---|---|---|---|
| | Knitting Machine | | HKS3M | HKS3M |
| | Gauge | | 28 | 28 |
| Knit Texture | Front Body | Yarn | PET Multifilament Yarn | PET Multifilament Yarn |
| | | Fineness | 130/24 | 130/24 |
| | | Yarn Arrangement | 1in 1out | 1in 1out |
| | | Knit Texture | 1-1/1-1/1-0/0-1 | 1-0/1-1/1-0/1-2 |
| | | Knit Texture | Chain | Denbigh |
| | | Overlap Direction | RL | RRL |
| | | Number of Courses (Base Texture) | 2 | 3 |
| | | Number of Courses (Insertion Texture) | 2 | 1 |
| | Middle Body | Yarn | PET Multifilament Yarn | PET Multifilament Yarn |
| | | Fineness | 130/24 | 130/24 |
| | | Yarn Arrangement | 1out 1in | 1out 1in |
| | | Knit Texture | 1-0/0-1/1-1/1-1 | 1-0/1-2/1-0/1-1 |
| | | Knit Texture | Chain | Denbigh |
| | | Overlap Direction | RL | RLR |
| | | Number of Courses (Base Texture) | 2 | 3 |
| | | Number Of Courses (Insertion Texture) | 2 | 1 |
| | Back Body | Yarn | PET Multifilament Processed Yarn | PET Multifilament Processed Yarn |
| | | Fineness | 167/48 | 167/48 |
| | | Yarn Arrangement | Full Set | Full Set |
| | | Knit Texture | Cord (3 Needles) 1-0/3-4 | Denbigh 1-0/1-2 |
| Warp Knitted Fabric | Weight (g/m$^2$) | | 240 | 180 |
| | Density | Courses | 38 | 60 |
| | | Wales | 34 | 33 |
| | Insertion Texture | Height (mm) | 0.1 | 0.2 |
| | | Exposure Ratio (%) | 50% | 25% |
| Evaluation | Design Properly | | B | D |
| | Stitch Characteristic | | B | C |
| | Tear Strength | | C | C |
| | Anti-Snagging Properly | | B | A |

DESCRIPTION OF REFERENCE NUMERALS AND SIGNS

1: front yarn, 2: middle yarn, 3: back yarn, 20, 21: a portion of an insertion structure

The invention claimed is:

1. A warp knitted fabric formed of yarns fed from at least three guide bars including front, middle, and back guide bars, comprising:

a back yarn having been fed from the back guide bar and forming a cord knit structure, a front yarn having been fed from the front guide bar, and a middle yarn having been fed from the middle guide bar, wherein:

the front yarn and the middle yarn are arranged alternately in a weft direction, each of the front yarn and the middle yarn forms a stitch formation structure and an insertion structure alternately in a warp direction, the stitch formation structure of each of the front yarn and the middle yarn is a denbigh knit structure or a cord knit structure, the denbigh knit structure representing an arrangement of two warp-knitted stitches that are knitted in alternate, adjacent wales in consecutive courses, the cord knit structure representing an arrangement of two warp-knitted stitches that are knitted in alternate, non-adjacent wales in consecutive courses, and the insertion structure formed by the front yarn and the insertion structure formed by the middle yarn are arranged alternately at least in the warp direction so that the front yarn and the middle yarn are exposed alternately at least in the warp direction on sinker loops of the back yarn.

2. The warp knitted fabric according to claim 1, wherein each of the front yarn and the middle yarn forms the denbigh knit structure and the insertion structure alternately in the warp direction.

3. The warp knitted fabric according to claim 1, wherein a ratio of the insertion structure exposed on a surface of the warp knitted fabric is 15 to 60%.

4. The warp knitted fabric according to claim 1, wherein the stitch formation structures and the insertion structures formed by the front yarn and the middle yarn are continuous in 1 to 5 courses.

5. The warp knitted fabric according to claim 1, wherein a height of the exposed portions of the front yarn and the middle yarn from the sinker loops of the cord knit structure of the back yarn is 0.1 to 2.0 mm.

6. The warp knitted fabric according to claim 1, wherein the front yarn and the middle yarn are respectively fed 1 in 1 out, 2 in 2 out, or 1 in 3 out.

7. A method of manufacturing a warp knitted fabric, comprising:

using a warp knitting machine provided with at least three guide bars including front, middle, and back guide bars;

knitting a cord knit structure by feeding a back yarn from the back guide bar;

knitting a stitch formation structure and an insertion structure alternately in a warp direction by feeding a front yarn from the front guide bar;

knitting a stitch formation structure and an insertion structure alternately in the warp direction by feeding a middle yarn from the middle guide bar;

knitting a denbigh knit structure or a cord knit structure as the stitch formation structure of each of the front yarn and the middle yarn, the denbigh knit structure representing an arrangement of two warp-knitted stitches that are knitted in alternate, adjacent wales in consecutive courses, the cord knit structure representing an arrangement of two warp-knitted stitches that are knitted in alternate, non-adjacent wales in consecutive courses; and arranging the insertion structure formed by the front yarn and the insertion structure formed by the middle yarn alternately at least in the warp direction so as to expose the front yarn and the middle yarn alternately at least in the warp direction on sinker loops of the back yarn.

8. The method of manufacturing the warp knitted fabric according to claim 7, comprising:

knitting the denbigh knit structure and the insertion structure alternately in the warp direction by feeding the front yarn from the front guide bar;

knitting the denbigh knit structure and the insertion structure alternately in the warp direction by feeding the middle yarn from the middle guide bar; and arranging the insertion structure formed by the front yarn and the insertion structure formed by the middle yarn alternately at least in the warp direction.

9. The method of manufacturing the warp knitted fabric according to claim 7, wherein a ratio of the insertion structure to be exposed on a surface of the warp knitted fabric is 15 to 60%.

10. The method of manufacturing the warp knitted fabric according to claim 7, comprising:

knitting the stitch formation structures and the insertion structures formed by the front yarn and the middle yarn to be continuous in 1 to 5 courses.

11. The method of manufacturing the warp knitted fabric according to claim 7, wherein a height of the exposed portions of the front yarn and the middle yarn from the sinker loops of the cord knit texture of the back yarn is 0.1 to 2.0 mm.

12. The method of manufacturing the warp knitted fabric according to claim 7, wherein the front yarn and the middle yarn are respectively fed 1 in 1 out, 2 in 2 out, or 1 in 3 out.

* * * * *